US005740821A

United States Patent [19]

Arnold

[11] Patent Number: 5,740,821

[45] Date of Patent: Apr. 21, 1998

[54] TANK CLEANING USING REMOTELY CONTROLLED MANWAY MOUNTED ROBOTIC SYSTEM

[75] Inventor: Kermit R. Arnold, Bacliff, Tex.

[73] Assignee: Landry Service Co. Inc., Bacliff, Tex.

[21] Appl. No.: 677,389

[22] Filed: Jul. 9, 1996

[51] Int. Cl.[6] ..... B08B 3/02

[52] U.S. Cl. ..... 134/113; 134/167 R; 134/181; 134/177; 134/175; 15/302; 15/321; 239/264

[58] Field of Search ..... 134/181, 172, 134/167 R, 198, 177, 175, 113; 15/302, 321; 239/264

[56] References Cited

U.S. PATENT DOCUMENTS

| | | | |
|---|---|---|---|
| 4,817,653 | 4/1989 | Krajicek et al. | 134/181 |
| 4,938,107 | 7/1990 | Mizuho et al. | 118/323 |
| 5,172,710 | 12/1992 | Harrington | 134/181 |
| 5,293,887 | 3/1994 | Thiborteau | 130/111 |
| 5,335,295 | 8/1994 | Allen | 15/1.7 |
| 5,482,063 | 1/1996 | Miura et al. | 134/167 R |
| 5,561,983 | 10/1996 | Landry et al. | 15/302 |
| 5,594,973 | 1/1997 | Brusseleers et al. | 134/167 R |
| 5,640,982 | 6/1997 | Landry | 134/167 R |

FOREIGN PATENT DOCUMENTS

| | | | |
|---|---|---|---|
| 1483371 | 6/1967 | France | 134/167 R |
| 2409759 | 9/1975 | Germany | 134/167 R |

*Primary Examiner*—Frankie L. Stinson
*Attorney, Agent, or Firm*—William J. Beard

[57] ABSTRACT

A cleaning system capable of passing through a manway entry point into a storage tank to be cleaned is disclosed. A remotely controllable robotic cannon for spraying diluent or water is provided which has a light source and CCTV camera axially mounted on the cannon nozzle assembly. Mounting systems permit sidewall or overhead deployment of the system as desired. Operators situated remotely can view and control the cleaning system via TV monitors.

5 Claims, 6 Drawing Sheets

TANK CLEANING USING REMOTELY CONTROLLED MANWAY MOUNTED ROBOTIC SYSTEM

BACKGROUND OF THE INVENTION

This invention relates to the cleaning of storage tanks used in petrochemical plants or oil refineries, and more particularly, to systems for removing waste materials which accumulate over time in such tanks.

In the petroleum refining and petrochemical chemical industries large storage tanks are in common usage. Various processes cause waste materials, both solid and liquid, to be generated along with the desired products. The accumulation of such waste materials, or sludge, can occur in these large storage tanks. It is not uncommon to have several feet of such sludge in the bottom of a single such large storage tank. The sludge usually contains a fairly high percentage of hydrocarbon which can be recycled if separated from the solid irreducible waste which may comprise catalyst fines, rust or other particulate matter developed in a particular chemical process.

In the prior art, heated diluent such as diesel fuel or light crude oil or water is directed by hand held hose inside a storage tank against the sludge therein. This can convert the sludge into a pumpable slurry which is then pumped from the tank and further treated to separate out reusable hydrocarbons and recycle the diluent while discarding the solid waste. It was also proposed in U.S. Pat. No. 4,817,653 to use a waste washing robot operated by a human operator positioned inside the tank to spray water under pressure against tank residue to cause dislodgment of the sludge or other waste. In copending U.S. application Ser. No. 08/3061706 filed Sep. 19, 1994 a dual tracked remotely operated robotic vehicle is used to travel about inside a large tank to be cleaned. Such a vehicle, however, requires human entry into the tank for its assembly and deployment. This risks human exposure to chemicals and also could vent undesirable chemicals to outside air.

In practicing such prior art, techniques it has often been necessary to have an observer in line of sight of the point of application of the water or heated diluent order to control this portion of the process. This has necessitated humans inside the tank being cleaned. Workers can thus be exposed to $H_2S$, benzene or other potentially poisonous or highly volatile atmospheres. In the present invention this potentially dangerous exposure is eliminated through the use of robotic, remote controlled devices operable from a safe distance from the tank. These devices may be placed inside the tank by entry through a small manway or port and do not require interior human entry for their operation.

The present invention includes a gas tight cleaning system. This system cleans and degasses above ground storage tanks without manned entry. The system of the present invention is ideal for tanks with hazardous materials and applications where volatile organic compound emissions must be controlled for regulatory compliance.

SUMMARY OF INVENTION

In the system of the present invention water or heated diluent is directed against tank sludge inside a tank being cleaned by a manway mounted robotic nozzle or cannon system. A lighting system and video camera on this robotic cannon system enable an operating technician located a safe distance away in a comfortable climate controlled portable building to operate the robotic nozzle or cannon, to direct the nozzle for a diluent or water, to the proper operating angle or position against the sludge, to operate an evacuation nozzle situated in the tank to pump out slurry created by the heated diluent or water, and to monitor $H_2S$, $O_2$ and LEL (LOWER EXPLOSIVE LIMIT) levels inside the tank. A microphone for audio monitoring may also be included in the robotic cannon system if desired. The robotic cannon system is hydraulically powered via an umbilical cable/hose system. A constant ground fault interrupter switch on the control unit alerts the operator if static dissipation grounding is lost. The cannon system may be suspended from a roof entry manway or may be cantileveral from a side entry manway or port into the tank to be cleaned. Positioning and movement of the robotic cannon or nozzle within the tank is accomplished by the operator observing a video monitor connected to the video aligned with the cannon axis. The slurry produced by the application of the diluent, or water, is pumped via the evacuation nozzle from the tank and can be treated for separation of solids and hydrocarbons.

The structure and operation of the present invention is best understood by reference to the following detailed description thereof, which is intended as illustrative rather than limitative, when taken in conjunction with the accompanying drawings, wherein:

DETAILED DESCRIPTION OF THE PREFERRED EMBODIMENT OF THE INVENTION

Figure 1:
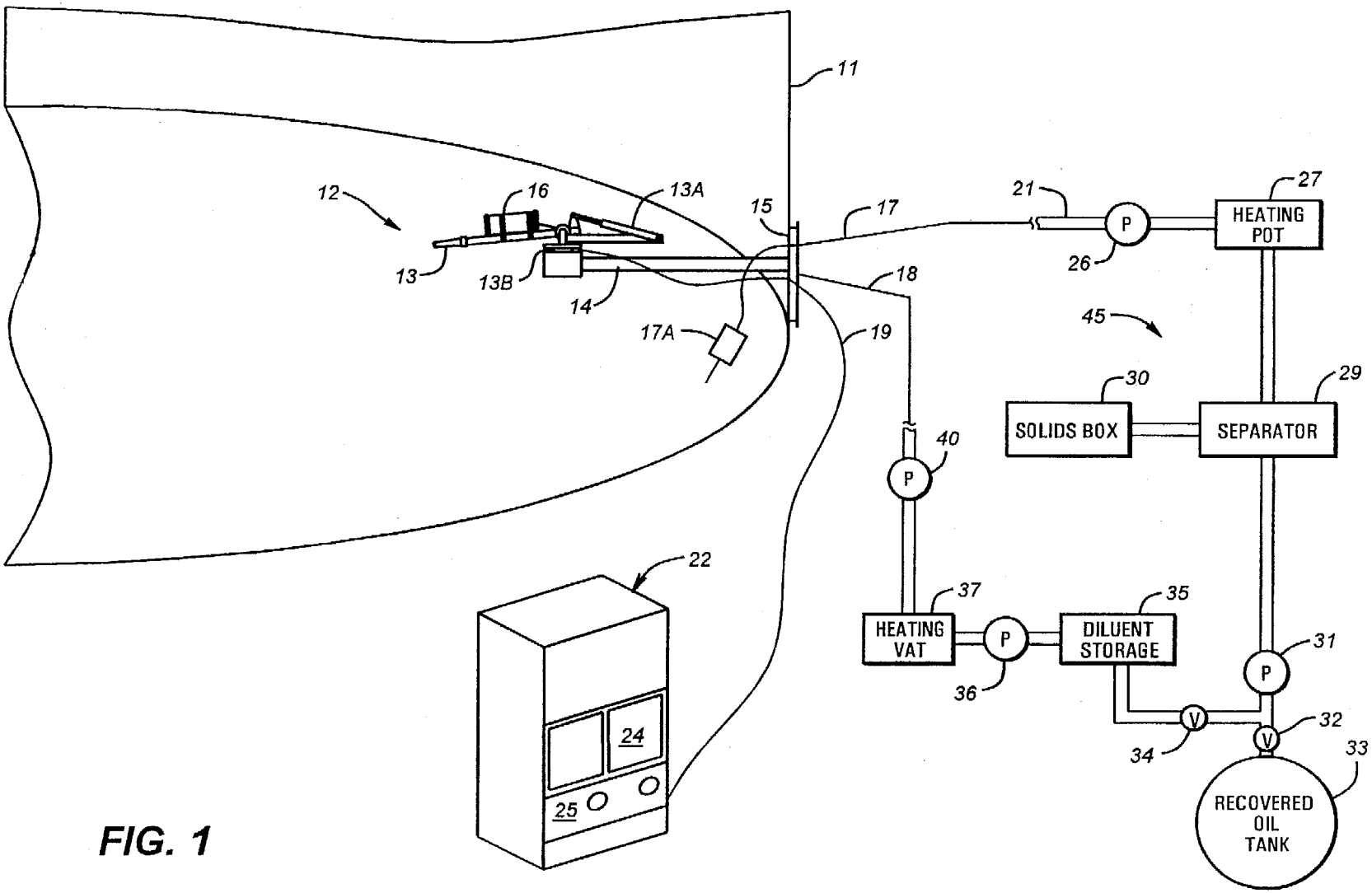
FIG. 1 is a schematic drawing showing an overall system according to concepts of the present invention deployed in tank to be cleaned using heated diluent and schematically showing the exterior processing of the pumpable slurry.

Referring initially to FIG. 1 a tank cleaning system employing generally the concepts of the present invention is shown schematically. A remote controlled robotic cannon nozzle system shown generally at 12, is deployed inside a tank 11 to be cleaned. The system 12 is attached to a remotely located control console 22 via an umbilical hose/cable system 17, 18, 19 to a diluent delivery hose 41, and via an evacuation hose 21, to a slurry processing system shown generally at 45. While illustrated here using a heated diluent cleaning system recirculating the diluent, it will be understood that it may be desirable to use pressurized water in some instances. The use of either and the use of other separation and recirculation systems is contemplated to be within the scope of the invention.

A cannon nozzle 13 which is movable in two axes via power of a pair of hydraulic actuators 13A and 13B is attached via a cantilever beam 14 to a manway cover 15. A video camera and a light source 16 are attached to the nozzle 13 so that video signals therefrom may be monitored at the control console video monitor screen 24 via the umbilical cablehose 17, 18, 19. The control console 22 is provided with a control panel 25 which contains appropriate controls and switches, which will be discussed in more detail later, for controlling the movement of the cannon nozzle 13 and camera 16 and light source apparatus from a safe, controlled environment, remote location while the systems is deployed in the tank to be cleaned.

Heated diluent is supplied via supply hose 41 to the cannon nozzle 13 of the system 12 where it is directed under the remote control (via console 22) of an operator against sludge to be removed from the tank 11. A pumpable slurry of solid and liquid including hydrocarbon is formed thereby. This slurry is pumped via an evacuation nozzle 17A, evacuation hose 21 and pump 26 to a heating pot 27. Heating pot 27 maintains the pumpability of the slurry which is usually pumped to a location somewhat removed from the tank 11 for further treatment. A separator 29 may comprise, for example, inclined shaker screens to separate out relatively large solid particles and/or a centrifugal separator to separate out finer solid particles. The separated solids are routed to a solids box 30 for disposal.

Heavier hydrocarbons are pumped from the separator 29 via pump 31 and valve 32 into a recovered oil tank 33. The lighter hydrocarbons and diluent are pumped via pump 31 and valve 34 into the diluent storage tank 35 where they may be recycled in the tank cleaning process. A pump 36 pumps diluent from the storage tank 35 to a heating vat 37 where it is heated to a temperature approximately 20° F. below its lowest flash point. It is then pumped via a pump 40 and the umbilical hose 41 and 18 to the cannon nozzle 13 as previously described.

Figure 2:
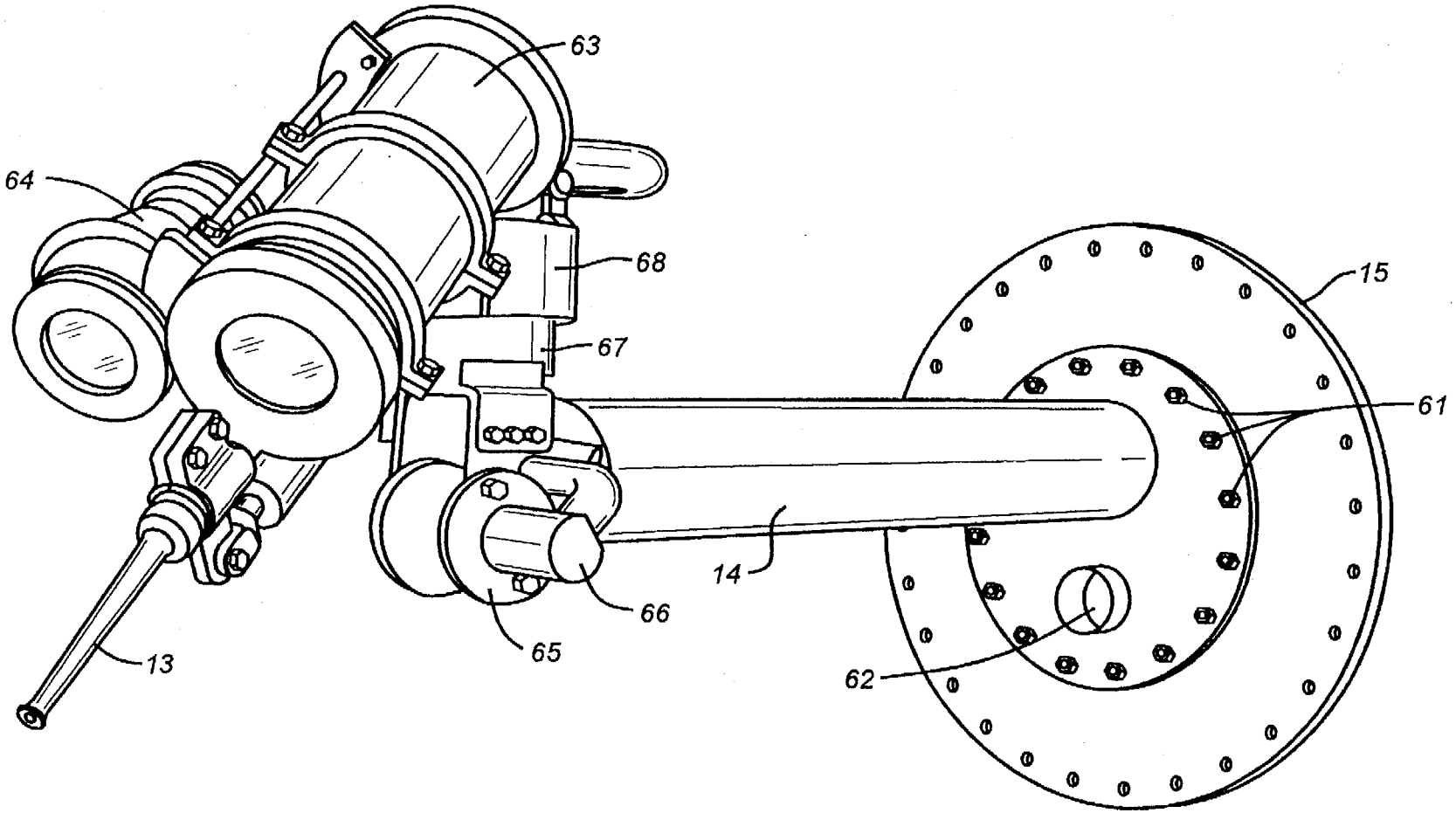
FIG. 2 is a schematic perspective view of the nozzle or cannon assembly cantilever mounted on a manway coverplate.
Figure 3:
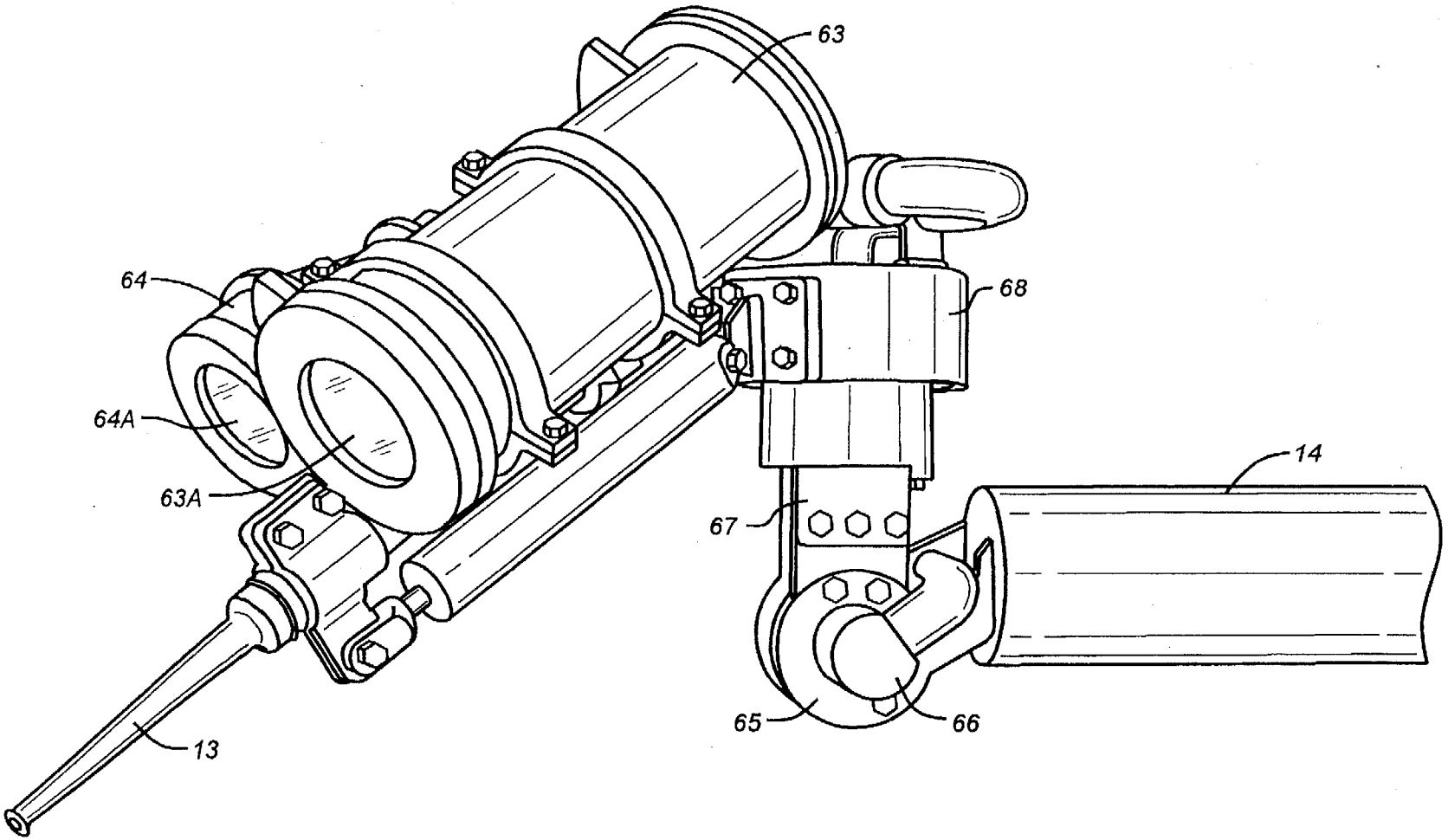
FIG. 3 is a schematic side view of the nozzle or cannon system FIG. 2 showing its articulation joints in more detail.

Referring now to FIGS. 2 and 3 the cannon nozzle system shown generally 12 in FIG. 1 is shown in perspective views from two different angles. Cantilever arm 14 is attached to manway cover hatch 15 which may be affixed to the side of the tank 11 by bolts 61 or the like. The cantilever beam 14 is hollow, and houses the various umbilical electrical cables, hydraulic, and diluent hoses 17, 18, 19 or the like shown schematically in FIG. 1. A port 62 is provided in cover 15 for the evacuation hose 17, 21 of FIG. 1 which passes therethrough and goes to the bottom of tank 11.

A sealed housing 63 is attached to nozzle 13 with its longitudinal axis parallel to that of nozzle 13. Housing 63 contains a video camera. A second sealed housing 64 contains a light source and is also mounted axially with the cannon nozzle 13. A first hydraulically powered gimbal or pivot 65 allows the arm 67 to pivot on axis 66 under remote control of the operator at console 22. A second hydraulically powered gimbal or pivot 68 is mounted to arm 67 and allows full 360 degree rotation of the cannon nozzle 13 light, camera assembly 63,64 about the axis of arm 67.

Figure 4:
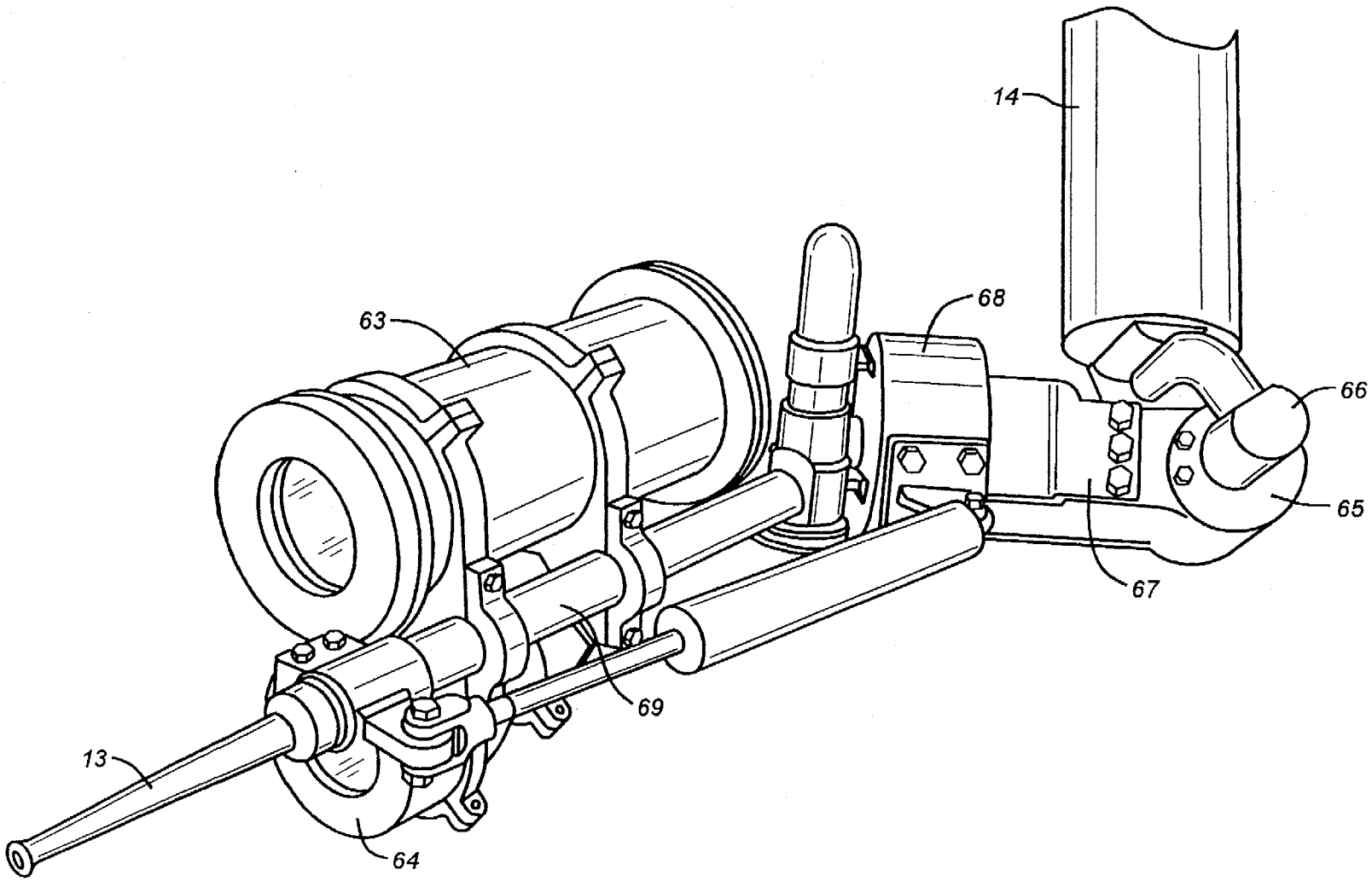
FIG. 4 is a schematic view of the robotic cannon/nozzle system shown suspended from a ceiling manway or port in a tank to be cleaned.

Referring now to FIG. 4 the mounting arm 14 of the system 12 is shown in the position where it is suspended from a roof manway or port (not shown) into the interior of tank 11. Again the first gimbal 65 permits motion about axis 66 of arm 67. Second hydraulically powered gimbal 68 permits rotation about the axis of arm 67.

The delivery of the diluent via nozzle 13 is monitored by video camera housed in housing 63,64 and light source which housings are fixedly strapped to the supply pipe 69 (FIG. 4). Thus the camera housing 63 always tracks and points in the general direction of the nozzle 13 and the effect of the delivered diluent on the sludge may be viewed by the operator. A microphone on the camera can provide audio monitoring of diluent delivery to the operator if desired.

This heated diluent is provided at a relatively low pressure of a few hundred PSI, the object being to break up the solid sludge and to form a pumpable slurry with it which is then picked up and pumped away via evacuation nozzle 17A. If water usage is contemplated rather than diluent, the system 12 and nozzle 13 are fully capable of handling higher pressures for fluid delivery if desired.

Figure 5:
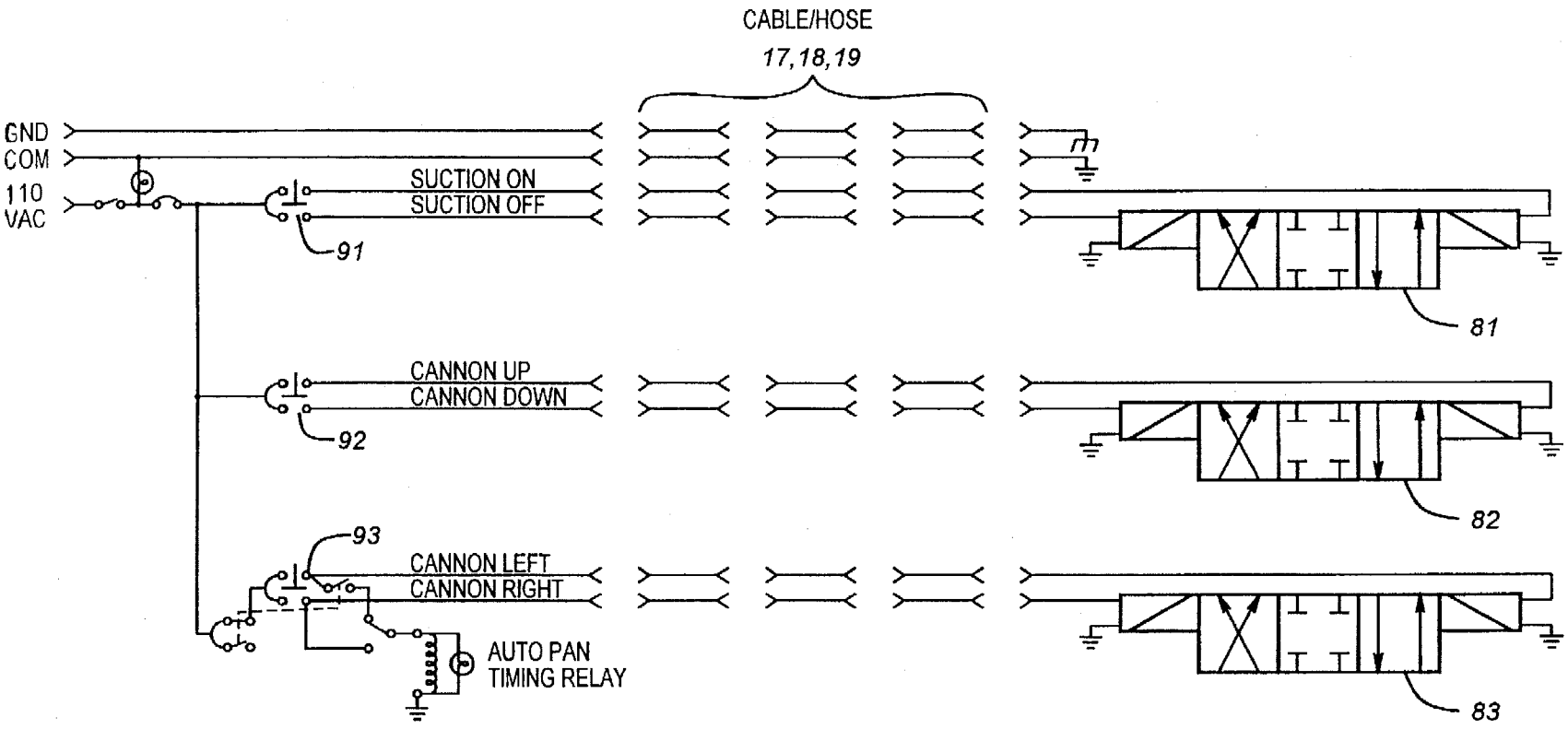
FIG. 5 is a schematic hydraulic and wiring diagram of a portion of the system shown in FIG. 1 for controlling the cannon nozzle and the slurry evacuation nozzle.
Figure 6:
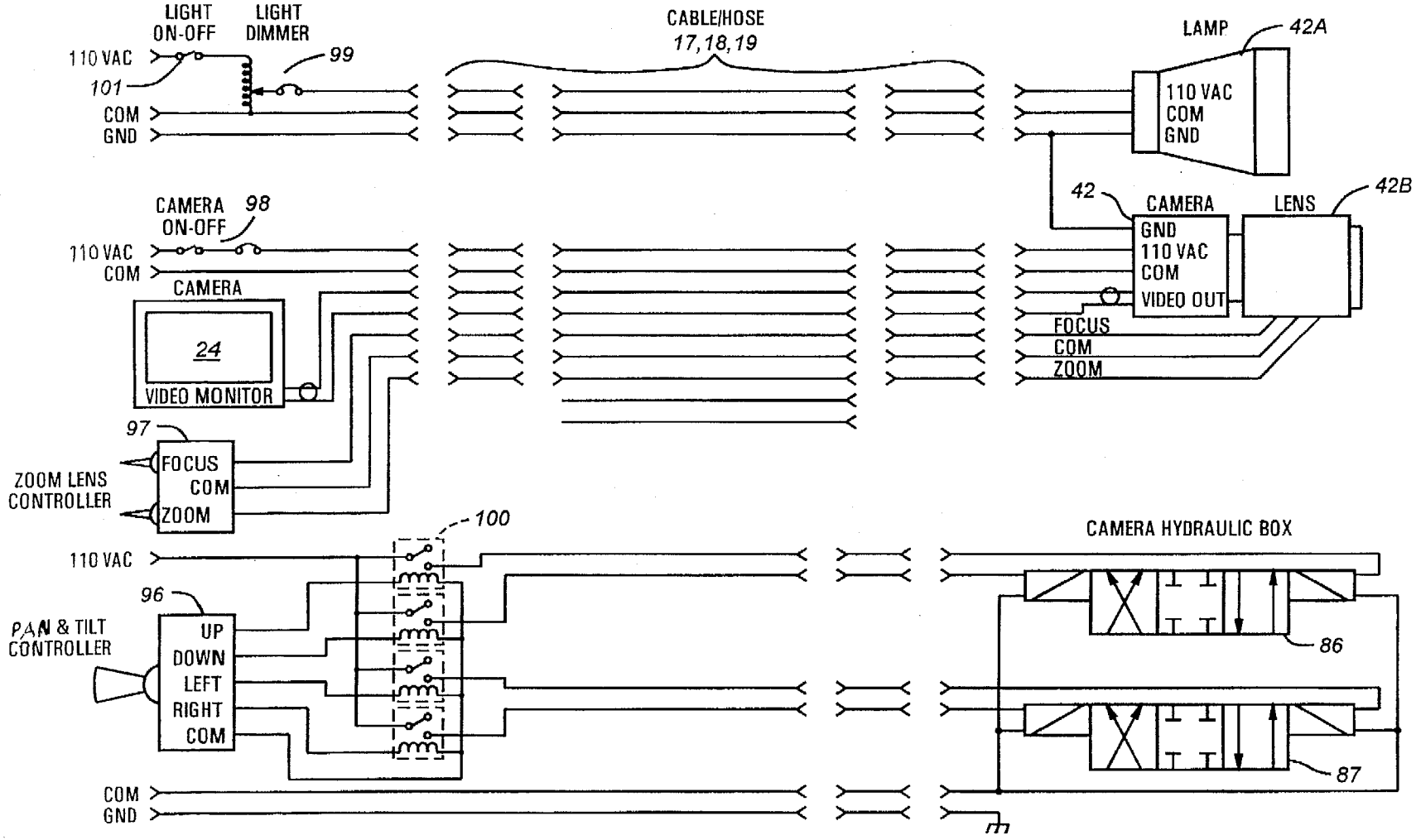
FIG. 6 is a schematic hydraulic and wiring diagram of a separate portion of the system of FIG. 1 for controlling the systems lights and video camera equipment.

Referring now to FIGS. 5 and 6 schematic electrical/hydraulic control diagrams are illustrated. Electric solenoidally activated hydraulic valves 81–83 of FIGS. 5–6 are located in a hydraulic manifold box inside mounting arm 14. This provides an explosion proof system in the event of spark generation. Control switches 91–99 are all mounted on the control console 22 (FIG. 1) and are connected to lamp 64.

For example, control switch 9 on console 22 in one position (up) provides current to solenoid activated hydraulic valve 81 to position a hydraulic activator (not shown) controlling evacuation nozzle 17A to the on position. In its opposite position switch 91 moves nozzle 17A to its off position.

Similarly, switch 92 in one position supplies current to solenoid operated hydraulic valve 82 to move a hydraulic actuator to lower nozzle 13 about its pivot point. In the opposite position switch 92 moves this actuator and nozzle 13 up similarly operating via hydraulic valve 82 and cable/hose system 17, 18, 19.

Switch 93 in one position supplies current to solenoid actuated hydraulic valve 83 to move a hydraulic actuator left or tight to direct pivotally mounted nozzle 13 in this manner.

Referring to FIG. 6 a pan and tilt controller joystick 96 is connected to a set of relays 100 in such a manner that relays 100 supply current to solenoid operated hydraulic valves 86 and 87 via cable/hose 18,17 to drive a pair of hydraulic actuators which can move the video camera housed in housing 63 about its vertical and longitudinal axes. This enables adjustment in the viewing angle of the camera in housing 65.

A zoom lens controller switch 97 supplies signals to zoom lens 42B on camera 42 via cable/hose 17,18 to cause the zoom lens 42B to change its magnification factor. Thus the monitoring of the effect of diluent or water from nozzle 13 may be monitored at different magnification as desired. A camera on/off control 98 is similarly connected via cable/hose 18,19 to the camera 42 (FIG. 1). Lens washer systems for the lenses of the light and of camera 42 A and 42B are supplied which direct clear water across these lenses to wash away any accumulation of debris which could obscure their view. The lens washers are switch controlled from the control panel 25(FIG. 1).

A light on/off control 101 and dimmer variac 99 in console 22 connected via cable/hose 18,17 (FIG. 1) to control the brightness of light source 42A associated with camera 42 in the manner shown in FIG. 6. Optimal brightness level for a given camera magnification factor may thus be controlled.

In operation, the system of the present invention can be operated 24 hours a day using shifts of operators to clean tanks quickly. Jobs that using manned equipment, would take months to perform become possible to perform in a matter of merely days. Safety of operation personnel is greatly enhanced. If desired the control console 22 can be provided with VHS video tape recorders to tape record the view of camera 42. Such tapes can be used for monitor purposes at a later time or for the training of operators in the use of the system.

The foregoing descriptions may render changes and modifications to the system obvious to those of skill in the art. The aim of appended claims is to cover all such modifications as fall within the true spirit and scope of the invention.

I claim:

1. A remotely controllable robotic cannon nozzle system sized and adapted for mounting in a manway port in a storage tank containing waste sludge or material to be removed, comprising:

a hollow mounting arm attachable to a manway or port cover on one end and having on its opposite end a pivotally mounted arm, said pivot being hydraulically powered and having on its end a second hydraulically powered pivot;

a cannon nozzle being attached to said second hydraulically powered pivot and having mounted therewith an axially aligned video camera, and an axially aligned light source;

means for supplying cleaning fluid to said nozzle under controllable pressure, the direction of said nozzle being remotely controllable by an operator, controlling the position of said first and second hydraulically powered pivots, in response to video images produced by said camera and said light source; and an evacuation nozzle and hose means attached thereto, being remotely controllable by said operator for pumping a pumpable slurry of effluent from the tank to be cleaned.

2. The system of claim 1 wherein the intensity of said light source is also remotely controllable by the operator.

3. The system of claim 2 wherein said video camera has a zoom lens and its magnification factor is remotely controllable by the operator.

4. The system of claim 1 wherein the supplied cleaning fluid is a heated diluent supplied at relatively low pressure of between one and two hundred pounds per square inch.

5. The system of claim 1, wherein the supplied cleaning fluid is water supplied at a relatively high pressure in excess of one thousand pounds per square inch.

* * * * *